US007069849B2

(12) United States Patent
Park et al.

(10) Patent No.: US 7,069,849 B2
(45) Date of Patent: Jul. 4, 2006

(54) IMAGE TRANSFER ELEMENT WITH LEVERAGE

(75) Inventors: Daniel C. Park, West Linn, OR (US); James B. Jensen, Woodburn, OR (US)

(73) Assignee: Xerox Corporation, Stamford, CT (US)

( * ) Notice: Subject to any disclaimer, the term of this patent is extended or adjusted under 35 U.S.C. 154(b) by 106 days.

(21) Appl. No.: 10/867,455

(22) Filed: Jun. 14, 2004

(65) Prior Publication Data

US 2005/0150398 A1 Jul. 14, 2005

Related U.S. Application Data

(60) Provisional application No. 60/535,857, filed on Jan. 12, 2004.

(51) Int. Cl.
*B41F 17/00* (2006.01)

(52) U.S. Cl. ..... 101/35

(58) Field of Classification Search ..... 101/35, 101/3.1, 418, 26, 33
See application file for complete search history.

(56) References Cited

U.S. PATENT DOCUMENTS 3,636,866 A * 1/1972 Stommel et al. ..... 101/22
4,104,963 A * 8/1978 Fortmann ..... 100/176
4,272,666 A * 6/1981 Collin ..... 219/216
6,050,052 A * 4/2000 Herron et al. ..... 53/118
6,398,435 B1 * 6/2002 Kozakai et al. ..... 400/144.2
2003/0180075 A1 * 9/2003 Hayami et al. ..... 399/328

FOREIGN PATENT DOCUMENTS

DE 32 31 905 A1 5/1983

OTHER PUBLICATIONS

English abstract for JP 06282198.
English abstract for JP 61 233761 A.
English abstract for JP 61 190365A.
English abstract for JP 10 293497 A.
English abstract for JP 61 212874 A.

* cited by examiner

*Primary Examiner*—Anthony H. Nguyen
(74) *Attorney, Agent, or Firm*—David J. Arthur

(57) ABSTRACT

An image transfer mechanism for a printer having a printer frame and an imaging drum attached to the printer frame includes a roller arm having a proximal end and a distal end, a transfer roller having a longitudinal axis, and a load arm having a proximal end and a distal end. The axis of the transfer roller is rotatably attached to the roller arm. The proximal end of the roller arm is attached to the load arm between the proximal end and the distal end of the load arm. The proximal end of the load arm is pivotally attached to the printer frame, and a load mechanism applies a load force to the distal end of the load arm to urge the load arm toward the imaging drum. An engaging mechanism selectively urges the distal end of the roller arm toward the imaging drum, which presses the load arm against the load force of the load mechanism.

24 Claims, 4 Drawing Sheets

IMAGE TRANSFER ELEMENT WITH LEVERAGE

This application claims the benefit of Provisional Patent Application No. 60/535,857, filed Jan. 12, 2004.

BACKGROUND AND SUMMARY

In various printing technologies, marking material is applied to the surface of an intermediate imaging element, such as a belt or a drum. The print media to which the image is ultimately to be applied (such as paper) is then pressed against the intermediate imaging element to transfer the image from the intermediate imaging element to the print media. In one example using electrostatographic or xerographic printing, an image of ink (liquid or dry toner) is formed on an electrically charged image receptor. The print media is pressed against the image receptor to transfer the image to the print media. The image is subsequently fused to the print media by applying pressure with a fuser roller. In another example using phase change ink jet printing, ink is deposited to form an image on the surface of an imaging drum. A transfix roller presses the print media against the image-bearing drum surface to transfer the ink image from the drum surface to the print media and fuse the ink image to the print media.

In many circumstances, it is desirable for the pressure applied to be constant, regardless of the thickness of the print medium. Therefore, displacement of the pressure applicator due to different thicknesses of print medium should not materially change the magnitude of the pressure applied. Furthermore, it is often desirable that the pressure applied be balanced across the width of the print medium.

In accordance with an aspect of the present invention, an image transfer mechanism for a printer having an imaging element includes a transfer roller having a rotational axis, and a transfer lever mechanism attached to the transfer roller for selectively urging the transfer roller against the printer imaging element. The transfer lever mechanism provides the transfer roller translational freedom of movement in at least one direction substantially perpendicular to the rotational axis of the transfer roller. A load mechanism attached to the transfer lever mechanism for applying a load force to the transfer roller when the transfer roller engages print media positioned between the imaging element and the transfer roller. Portions of the load mechanism can be placed somewhat away from the transfer roller, in positions in which more space may be available within the printer.

In accordance with another aspect of the present invention, an image transfer mechanism for a printer having a printer frame and an imaging drum attached to the printer frame includes a roller arm having a proximal end and a distal end, a transfer roller having a longitudinal axis, and a load arm having a proximal end and a distal end. The axis of the transfer roller is rotatably attached to the roller arm. The proximal end of the roller arm is attached to the load arm between the proximal end and the distal end of the load arm. The proximal end of the load arm is pivotally attached to the printer frame, and a load mechanism for applying a load force to the distal end of the load arm urges the load arm toward the imaging drum. An engaging mechanism selectively urges the distal end of the roller arm toward the imaging drum.

DETAILED DESCRIPTION

Figure 1:
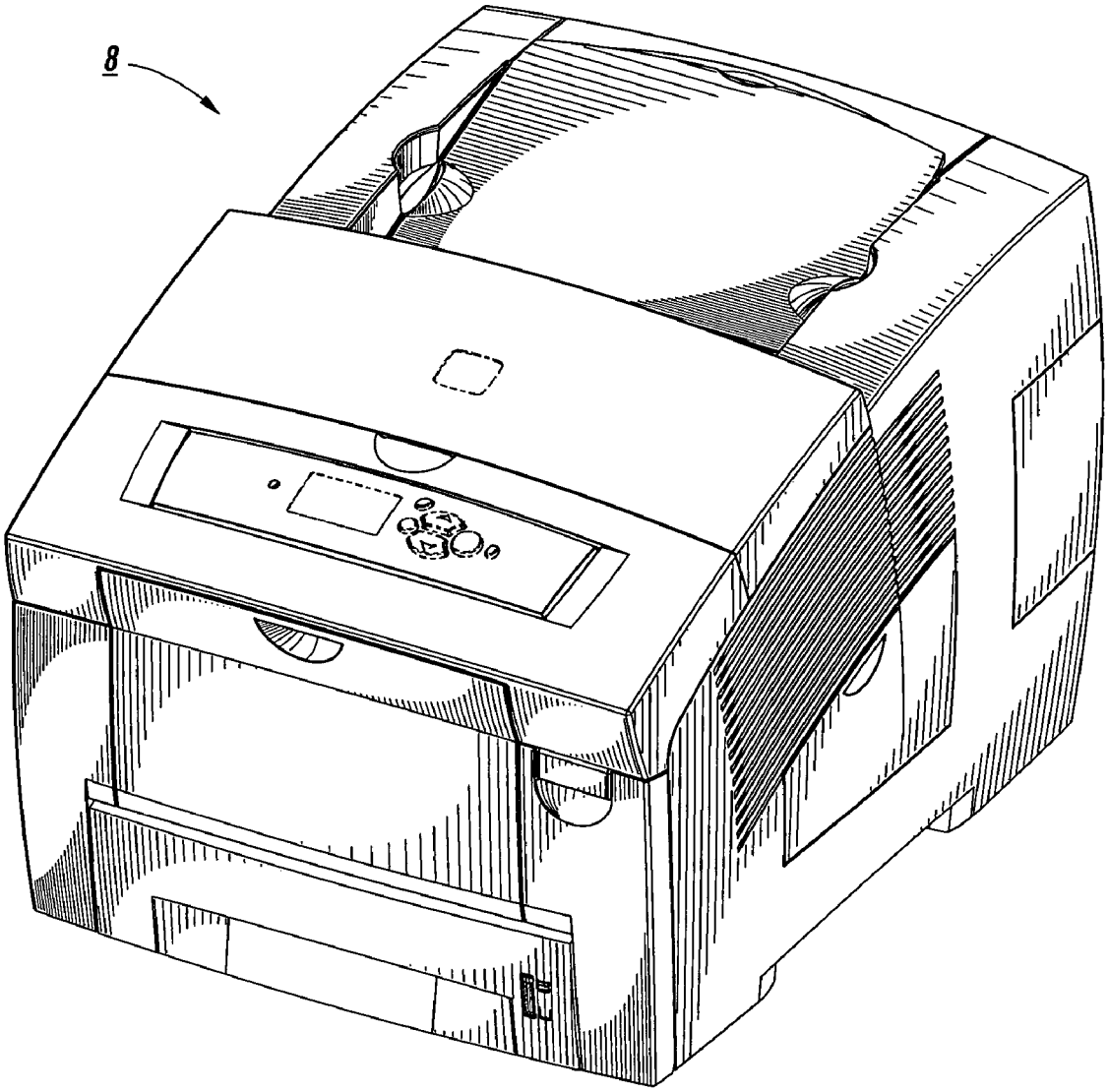
FIG. 1 is a perspective view of an exemplary phase change ink jet printer incorporating an embodiment of the present invention.

A printer 8 (FIG. 1) includes a housing or shell that encloses a print mechanism (not shown). The present description references a phase change ink jet print mechanism. However, persons familiar with printing technologies will recognize that the print mechanism may also encompass a xerographic or other electrostatic print mechanism.

In a phase change inkjet printer, ink is typically delivered to the printer in a solid form. An ink delivery mechanism melts the ink to a liquid form, and delivers the liquid ink to an inkjet printhead. The inkjet printhead ejects drops of the liquid ink from a multitude of inkjet nozzles onto an imaging element, typically an oil-coated drum. After the printhead forms the image on the surface of the imaging element, a transfix mechanism causes the image to be transferred from the imaging element to a print medium, such as paper, card stock, transparency, vinyl, etc. In certain implementations, this transfer process is called transfix because the image is simultaneously transferred and bonded (or fixed) to the print medium. The present description refers to a transfix mechanism that simultaneously transfers and bonds the image to the print medium. However, the principles, structures, and methods described are applicable to a variety of mechanisms in which a uniform, regulated pressure is to be applied, including different types of transfer and fusing rollers.

Figure 2:
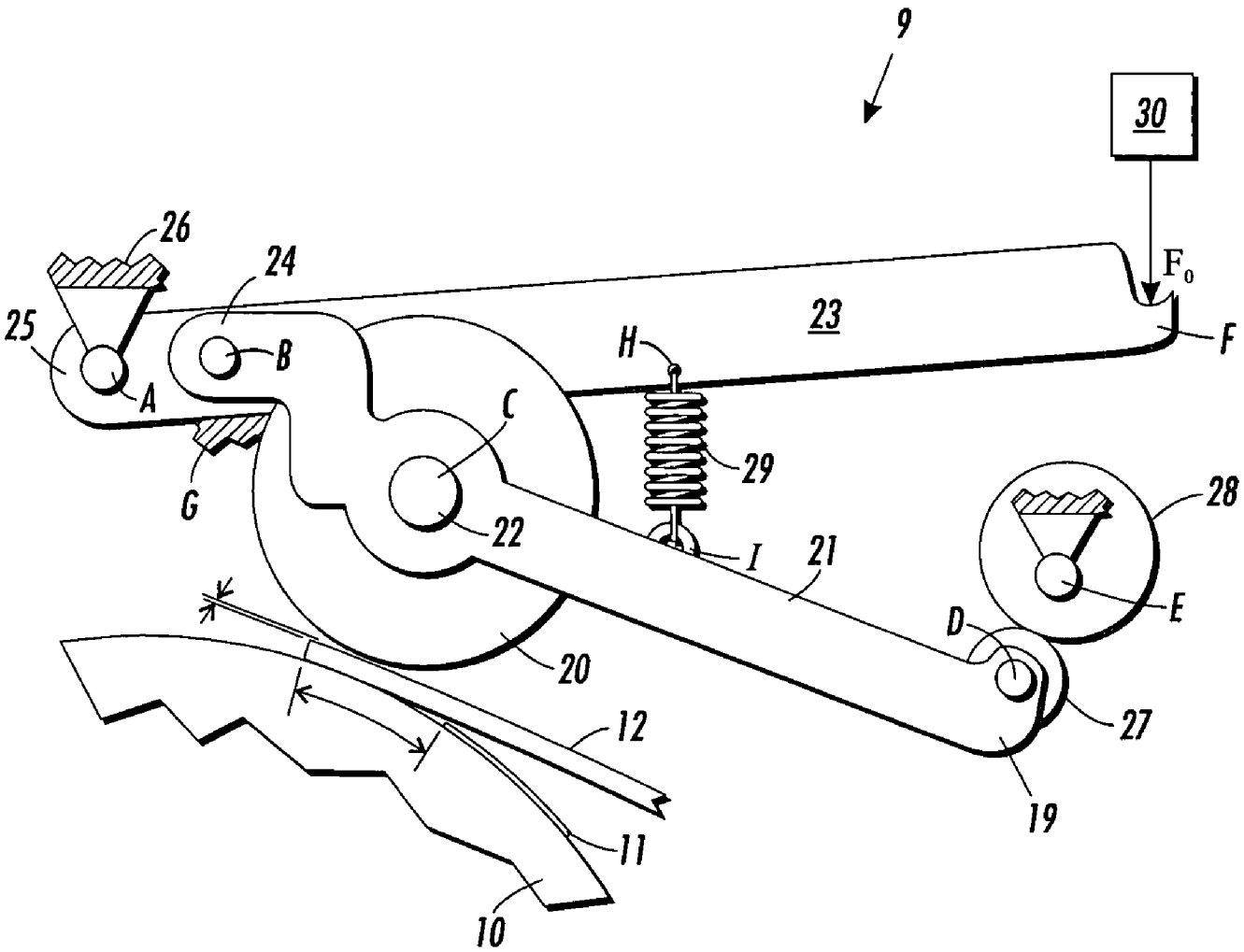
FIG. 2 is a view, partially in cross section, of a transfix roller mechanism incorporating an embodiment of an aspect of the present invention.

Referring to FIG. 2, an exemplary image transfer or transfix mechanism 9 includes an imaging drum 10 on which an image 11 has been formed, and a transfer element, such as a transfix roller 20, used to apply pressure to media 12 interposed between the drum 10 and the roller 20. FIG. 2 is an end view of the transfix mechanism. The imaging drum has a width extending substantially parallel to the axis 22 of the transfix roller 20. The transfix roller extends across the width of the imaging drum. Another transfix mechanism, which may be identical to the one shown in FIG. 2, is positioned at the opposite side of the imaging drum.

Pressure applied by the transfix roller 20 enhances transfer of the image 11 from the drum 10 to the media 12. A transfix lever mechanism transfers forces to the transfix roller so that the transfix roller applies consistent pressure while accommodating different thicknesses of media.

To transfer the image 11 from the drum 10 to the media 12, the transfix roller is pressed toward the imaging drum 10 by a transfix lever assembly that includes a transfer element mount, such as a roller arm 21. The axis of the imaging drum (not shown) is fixed with respect to the printer frame. The axis of the transfix roller is not fixed with respect to the printer frame. The transfix roller 20 has an axis 22 fixed to the roller arm 21 at roller pivot C. The roller arm is movable so that the axis of the transfix roller is translatable with respect to the axis of the imaging drum. The proximal end 24 of the roller arm 21 is attached to a load element that urges the roller arm and the transfix roller toward the drum. The load element is movable with respect to the printer frame so that the proximal end of the roller arm is not fixed with respect to the printer frame. The axis of the transfix roller is translatable in directions perpendicular to the axis, allowing the transfix roller to assume a position relative to the imaging drum that accommodates media of essentially any thickness. The transfix lever assembly presses the transfix roller toward the imaging drum to apply a transfix force regardless of the thickness of the media.

One portion of the transfer element mount, such as the distal end 19 of the roller arm 21, includes an engaging mechanism to selectively urge the roller arm toward the imaging drum for the transfix operation. In an embodiment, one portion of the engaging mechanism is a transfix cam follower 27 that rotates on cam follower pivot D and is engaged by a transfix cam 28 that forms another part of the engaging mechanism. The engaging mechanism is capable of applying an engaging force to the roller arm to move the roller arm in an engaging direction so that the transfix roller is urged toward the imaging drum. In an embodiment, the transfix cam in its engaged orientation applies up to approximately 60 pounds of engaging force to the roller arm.

The load element urges another portion of the transfer element mount in a loading direction so that the transfer element is urged toward the surface of the imaging element. In an embodiment, the load element for pressing the roller arm and the transfix roller against the imaging drum is a load arm 23 having a load force $F_0$ at the distal end thereof F. The proximal end 24 of the roller arm is attached to the load arm 23 at an arm pivot B. The load arm with its load force $F_0$ presses the proximal end of the roller arm and transfix roller toward the drum. The movement of the load element in the loading direction toward the imaging element is limited. In an embodiment, the range of movement of the load element 23 is limited at one side by a load stop G. This limitation on the movement of the load element to which a portion of the transfer mount is attached limits the movement of the transfer element mount (and the transfix roller) toward the surface of the imaging element. The limit allows the lever mechanism to stop the transfix roller from applying pressure to the surface of the imaging element when the imaging mechanism is not urging the roller arm in the engaging direction.

The load arm 23 has a length such that the load mechanism 30 is positioned away from the immediate vicinity of the transfix roller. Positioning the load mechanism away from the transfix roller removes space limitations that could arise in trying to position the load mechanism adjacent the transfix roller. For example, the load mechanism is advantageously placed in a portion of the printer housing having ample space for the springs and other load equipment.

The transfix roller accommodates media of different thicknesses by having its axis 22 translatable to different distances from the surface of the imaging drum depending on the thickness of the media engaged. The portion of the transfer element mount (the proximal end 24 of roller arm 21) attached to the load element accommodates translation of the transfix roller. The load element is movable relative to the printer frame, to accommodate movement of the roller arm upon which it acts. In an embodiment, the proximal end 25 of the load arm 23 is connected to a frame 26 of the printer via a frame pivot connection A. As the load arm pivots on the frame pivot connection A, the distal end F of the load arm is displaced against a load force $F_0$ applied by a load mechanism 30.

As shown in FIG. 2, the transfix mechanism is in a disengaged position. The load arm 23 rests at fixed stop G on a fixed portion of the printer frame, which keeps the load element from pressing the roller arm and transfix roller further toward the drum. The load mechanism 30 applies the load force $F_0$ at a load attachment at the distal end F of the load arm 23 to hold the load arm against the fixed stop G. A roller bias spring 29 holds the transfix roller away from the drum surface to provide space between the surface of the imaging drum and the surface of the transfix roller for the image 11, and for at least a portion of the media 12 when the engaging mechanism is not urging the roller arm in the engaging direction. The roller bias spring 29 is connected to the roller arm at a roller arm bias connection point I on the roller arm 21 to bias the roller arm away from the drum surface. This roller bias spring holds the roller arm in position with the cam follower 27 against the transfix cam 28, so that the transfix roller 20 is separated from the surface of the imaging drum 10 and the media 12. In an embodiment, the other end of the roller bias spring is connected to a fixed portion of the printer frame (not shown). In an alternative, the other end of the roller bias spring may be connected to the load arm at load arm bias connection point H. The bias force provided by the roller bias spring 29 is only a small fraction of the load force $F_0$. In an example, the force of the roller bias spring 29 may be a few pounds (less than 10 pounds, and particularly less than 5 pounds).

Figure 3:
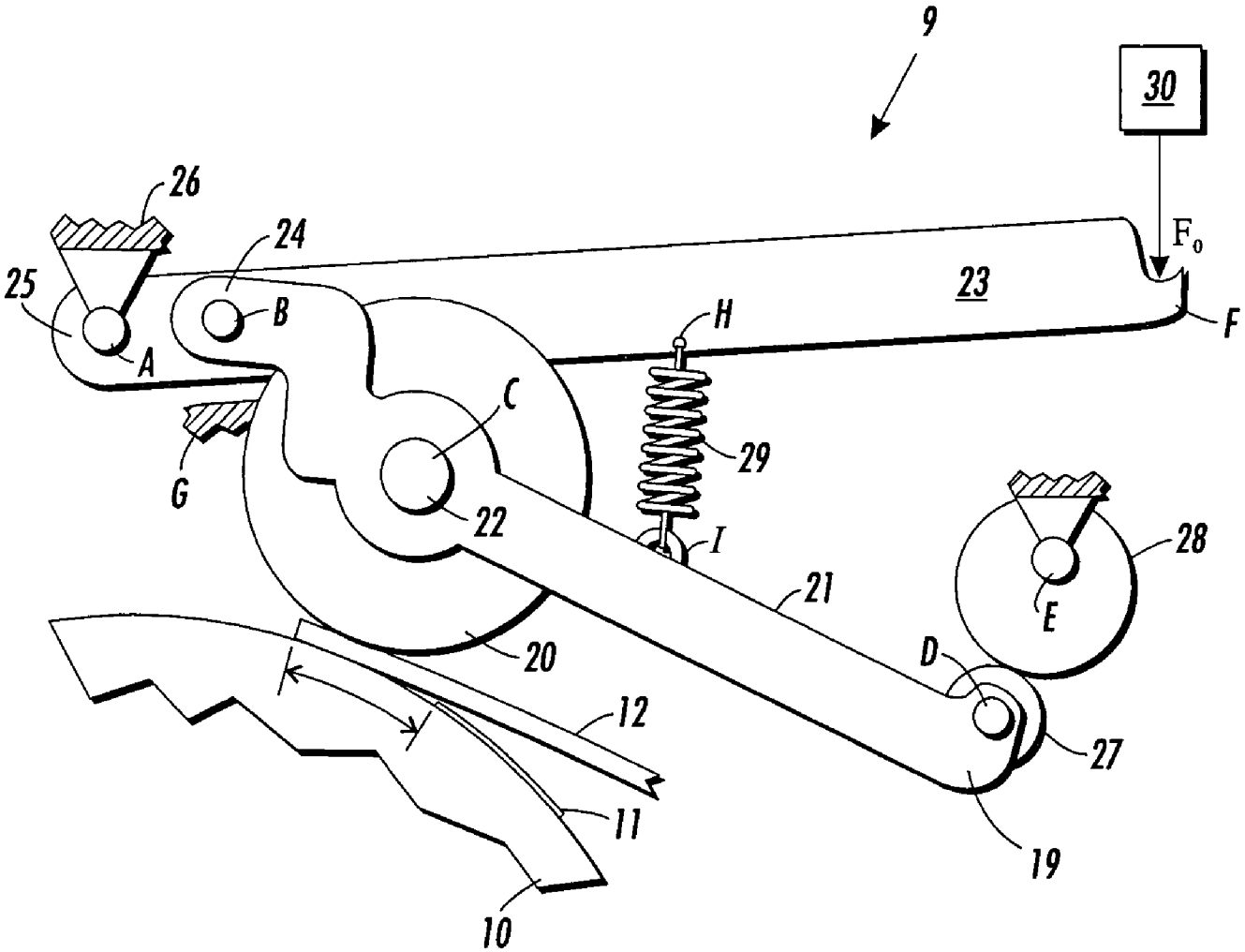
FIG. 3 is a view, partially in cross section, of the transfix roller mechanism of FIG. 2, showing the transfix roller engaged with a print medium on the imaging drum.

FIG. 3 shows the exemplary transfix mechanism in an engaged position, applying a transfix pressure to press the media 12 against the surface of the imaging drum. Such pressure will cause the image 11 to be transferred and fixed to the media 12 as the imaging drum rotates. To engage the transfix mechanism, the engaging mechanism presses the roller arm (and the transfix roller) toward the imaging drum. In an embodiment, the transfix cam 28 is rotated about pivot E so that the cam 28 engages the cam follower 27 to cause the distal end 19 of the roller arm 21 to move toward the imaging drum. So moving the roller arm initially causes the roller arm to rotate about its proximal end 24 at the pivot B until the transfix roller 20 engages the media 12. Once the transfix roller has engaged the media, and the transfix cam 28 continues to rotate to press against the roller arm, the roller arm rotates about pivot C, which is the axis 22 of the transfix roller 20. To the extent that the transfix roller 20 deforms under pressure, there may be some additional rotation about arm pivot B. In the fully engaged orientation, the cam 28 applies an engagement force to the distal end of the roller arm, which then presses the transfix roller against the media on the surface of the imaging drum. The leverage provided by the roller arm establishes a force of the transfix roller 20 against the media on the imaging drum due to the cam is much larger than the cam force on the distal end of the roller arm. In an example, the cam force at the end of the roller arm may be approximately 60 pounds. The leverage may be such that the force of the transfix roller 20 against the media on the imaging drum is a multiple of the cam force, for example, 5 times the magnitude of the cam force.

Once the transfix roller has engaged the media, the proximal end of the roller arm then presses against the load arm, lifting the load arm against the load force $F_0$ applied by the load mechanism 30, and rotating the load arm about a load arm pivot A. The arrangement of the transfix mechanism leverages the load force $F_0$ so that the force of the transfix roller 20 against the media on the imaging drum is much larger than the load force on the distal end F of the load arm. In an example, the load force $F_0$ at the distal end F of the load arm may be approximately 30 pounds. The leverage may be such that the force of the transfix roller 20 against the media on the imaging drum is a multiple of the load force $F_0$, for example, 10 times the magnitude of the load force $F_0$.

With the leverage provided by the arrangement of the transfix mechanism on each end of the transfix roller, the force applied to the media 12 by the transfix roller due to the load mechanism acting on the distal end F of the load arm 23 is approximately 10 times the load force $F_0$. As noted above, the force applied to the media 12 by the transfix roller due to the engagement cam is approximately 5 times the force applied by the engagement cam directly. Thus, for an embodiment in which each of a pair of load mechanisms provides a load force $F_0$ of 30 pounds, and each of a pair of engagement cams provides an engagement force of 60 pounds, the transfix roller can apply approximately 600 pounds of force to press the media against the surface of the imaging drum.

A constant load force $F_0$ ensures that the transfix pressure against the media 12 is constant when the transfix mechanism is engaged. Media 12 of different thicknesses will cause the distal end F of the load arm 23 to assume a position within a range of position when the transfix mechanism is engaged. The deflection of the load attachment point at the distal end of the load arm 23 thus depends on the thickness of the media 12. Ideally, the load force $F_0$ applied to the distal end F of the load arm 23 should not change as the amount of deflection changes. The load force is supplied by a load mechanism such as the load mechanism described in copending U.S. patent application Ser. No. 10/843,855, entitled IMAGE TRANSFER ELEMENT WITH BALANCED CONSTANT LOAD FORCE, filed on May 12, 2004 by inventors Daniel Clark Park et al., the contents of which are hereby incorporated by reference.

Various other load mechanisms can be used to supply the load force $F_0$ at the distal end F of the load arm 23. In other embodiments, the load mechanism 30 may include a simple spring, such as a tension or compression spring. In particular, the load mechanism may include a long extension spring having a low spring rate, so that extension of the spring by movement of the load arm 23 does not materially change the magnitude of the load force $F_0$ at the distal end F of the load arm.

The transfix mechanism defaults to a disengage position, should an equipment malfunction or loss of power occur. Such a disengage default releases the media so that the media can be removed in the event of a jam, and also avoids damage to the imaging element and/or the transfix roller that might occur if the transfix roller were left applying the full transfix force against the surface of the imaging element.

If the engaging mechanism loses power, it tends to release its engaging force. For example, a cam motor driving the transfix cam 28 typically depends on continued power to hold the cam 28 in the engage orientation shown in FIG. 3. If the cam motor loses power, the transfix cam 28 rotates into the disengage orientation shown in FIG. 2. The load force $F_0$ applied by the load mechanism 30 to the distal end F of the load arm 23 presses the load arm toward and against the fixed stop G. This lowering of the pivot B and the proximal end 24 of the roller arm 21, and the rotation of the cam 28 into the disengage orientation allows the roller bias spring to draw the roller arm 21 away from the surface of the imaging element.

Figure 4:
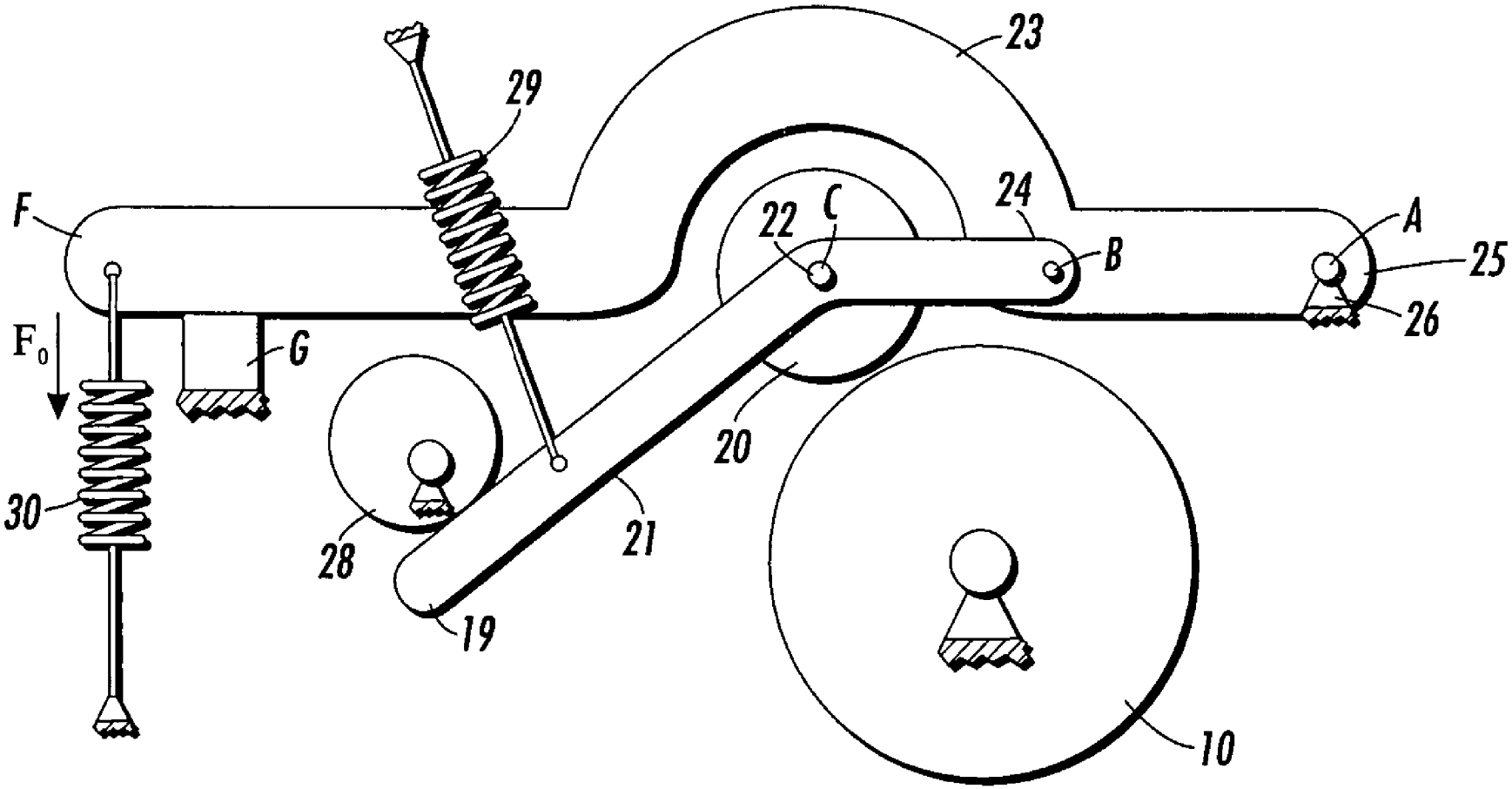
FIG. 4 is a view, partially in cross section, of another embodiment of a transfix roller mechanism incorporating aspects of the present invention.

FIG. 4 illustrates another embodiment of a transfix roller mechanism parts corresponding to the parts described in connection with the embodiment of FIGS. 2 and 3 bear the same numbers, although their physical appearance may differ. Those skilled in the art will recognize that the embodiment shown in FIG. 4 functions in the same way as the embodiment shown in FIGS. 2 and 3.

The detailed description provided above describes particular embodiments and includes details that can be varied without departing from the spirit and principles of the invention. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

We claim:

1. An image transfer mechanism for a printer having a frame and an imaging element attached to the frame, the image transfer mechanism comprising:

a load arm movable with respect to the frame;

a transfer element arm;

a transfer element attached to the transfer element arm;

wherein a first portion of the transfer element arm is attached to the movable load arm so that the load arm urges the transfer element toward the imaging element; and an engaging mechanism for selectively moving a second portion of the transfer element arm in an engaging direction to urge the transfer element toward the imaging element.

2. The image transfer mechanism of claim 1, wherein:

the load arm has a proximal end pivotally attached to the frame, and has a distal end;

the transfer element arm is a roller arm having a proximal end and a distal end;

the first portion of the transfer element arm comprises the proximal end of the roller arm; and the second portion of the transfer element arm comprises the distal end of the roller arm.

3. The image transfer mechanism of claim 2, wherein:

as the load arm pivots in a loading direction, the transfer element is urged toward the imaging element; and the transfer element additionally comprises a stop for limiting pivoting of the load arm in the loading direction.

4. The image transfer mechanism of claim 3, additionally comprising a load mechanism attached to the distal end of the load arm, wherein the load mechanism urges the load arm to pivot in the loading direction.

5. The image transfer mechanism of claim 4, wherein as the distal end of the roller arm moves in the engaging direction, the proximal end of the roller arm urges the load arm against the load applied by the load mechanism.

6. The image transfer mechanism of claim 3, wherein as the distal end of the roller arm moves in the engaging direction, the proximal end of the roller arm urges the load arm in an unloading direction, opposite the loading direction.

7. The image transfer mechanism of claim 6, additionally comprising a bias element attached to the transfer element arm, wherein the bias element biases the transfer element arm away from the engaging position.

8. The image transfer mechanism of claim 3, additionally comprising a stop for limiting the pivoting of the load arm in the loading direction.

9. An image transfer mechanism for a printer having a frame and an imaging element attached to the frame, the image transfer mechanism comprising:

a load arm movable with respect to the frame;

a transfer roller arm having a proximal end portion and a distal end portion;

a transfer roller having an axis of rotation attached to the transfer element arm;

wherein a proximal end portion of the transfer roller arm is attached to the movable load arm so that the load arm urges the transfer roller toward the imaging element; and an engaging mechanism for selectively moving a distal end portion of the transfer roller arm in an engaging direction to urge the transfer roller toward the imaging element.

10. The image transfer mechanism of claim 9, wherein the load arm has a proximal end pivotally attached to the frame, and a distal end; and the proximal end portion of the transfer roller arm is attached to the load arm between the proximal end and the distal end of the load arm.

11. The image transfer mechanism of claim 10, wherein:

as the load arm pivots in a loading direction, the load arm moves the transfer roller arm in an engaging direction so that the transfer roller is urged toward the imaging element; and the image transfer mechanism additionally comprises a stop for limiting the pivot of the load arm in the loading direction.

12. The image transfer mechanism of claim 11, additionally comprising a load mechanism attached to the distal end of the load arm, wherein the load mechanism urges the load arm to pivot in the loading direction.

13. The image transfer mechanism of claim 12, additionally comprising a bias element attached to the transfer roller arm, wherein the bias element biases the transfer roller arm away from the engaging position.

14. An image transfer mechanism for a printer having an imaging element, the image transfer mechanism comprising:

a transfer roller arm having a proximal end and a distal end;

a transfer roller attached to the transfer roller arm between the proximal end and the distal end of the transfer roller arm;

an engaging mechanism for selectively moving the distal end of the transfer roller arm toward the imaging element;

a load arm having a proximal end and a distal end;

wherein the proximal end of the transfer roller arm is attached to the load arm between the proximal end and the distal end of the load arm; and wherein movement of the distal end of the load arm in a loading direction urges the proximal end of the transfer roller arm toward the imaging element.

15. The image transfer mechanism of claim 14, additionally comprising a stop to limit the movement of the proximal end portion of the transfer roller arm toward the imaging element.

16. The image transfer mechanism of claim 15, additionally comprising:

a load on the distal end of the load arm adapted to urge the load arm in a load direction to urge the proximal end of the transfer roller arm toward the imaging element; and wherein the stop comprises a stop to limit the range of movement of the load arm in the load direction.

17. The image transfer mechanism of claim 16, wherein:

the proximal end portion of the load arm is pivotally attached to the printer frame; and the load on the distal end of the load arm urges the load arm to pivot in the load direction about the proximal end portion of the load arm.

18. The image transfer mechanism of claim 16, wherein as the engaging mechanism moves the distal end of the transfer roller arm toward the imaging element, the proximal end of the transfer roller arm presses the load arm in an unload direction, opposite the load direction.

19. The image transfer mechanism of claim 16, wherein the engaging mechanism comprises a cam mechanism.

20. The image transfer mechanism of claim 19, wherein the cam mechanism comprises:

a cam follower connected to the roller arm; and a cam engaging the cam follower.

21. The image transfer mechanism of claim 20, additionally comprising a bias spring connecting the roller arm for holding the roller arm and the transfer roller away from the imaging element except when the cam mechanism moves the roller arm toward the imaging element.

22. The image transfer mechanism of claim 15, additionally comprising a bias spring connecting the roller arm and the load arm for holding the roller arm and the transfer roller away from the imaging element except when the actuator moves the roller arm toward the imaging element.

23. An image transfer mechanism for a printer having a printer frame and an imaging drum attached to the printer frame, the image transfer mechanism comprising:

a roller arm having a proximal end and a distal end;

a transfer roller having a longitudinal axis, wherein the axis of the transfer roller is rotatably attached to the roller arm between the proximal end and the distal end;

a load arm having a proximal end and a distal end;

wherein the proximal end of the roller arm is attached to the load arm between the proximal end and the distal end of the load arm;

wherein the proximal end of the load arm is pivotally attached to the printer frame;

a load mechanism for applying a load force to the distal end of the load arm to urge the load arm against the proximal end of the roller arm to urge the transfer roller toward the imaging drum; and an engaging mechanism for selectively urging the distal end of the roller arm toward the imaging drum;

wherein movement of the distal end of the roller arm toward the imaging drum causes the proximal end of the roller arm to press the load arm against the load force provided by the load mechanism.

24. The image transfer mechanism of claim 23, additionally comprising a stop for limiting the movement of the load arm toward the imaging drum.

* * * * *